US010184333B2

(12) United States Patent
Gosney et al.

(10) Patent No.: US 10,184,333 B2
(45) Date of Patent: Jan. 22, 2019

(54) DYNAMIC AGITATION CONTROL APPARATUS, SYSTEMS, AND METHODS

(71) Applicant: Halliburton Energy Services, Inc., Houston, TX (US)

(72) Inventors: Jon Troy Gosney, Bellville, TX (US); Paul F. Rodney, Spring, TX (US); Huzefa Shakir, Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 357 days.

(21) Appl. No.: 14/424,246

(22) PCT Filed: Nov. 20, 2012

(86) PCT No.: PCT/US2012/066094
§ 371 (c)(1),
(2) Date: Feb. 26, 2015

(87) PCT Pub. No.: WO2014/081417
PCT Pub. Date: May 30, 2014

(65) Prior Publication Data

US 2015/0267534 A1 Sep. 24, 2015

(51) Int. Cl.
*E21B 7/18* (2006.01)
*E21B 7/24* (2006.01)
(Continued)

(52) U.S. Cl.
CPC ..... *E21B 47/18* (2013.01); *E21B 4/02* (2013.01); *E21B 7/18* (2013.01); *E21B 7/24* (2013.01);
(Continued)

(58) Field of Classification Search
CPC ... E21B 7/18; E21B 7/24; E21B 47/18; E21B 47/16; E21B 28/00; E21B 21/08;
(Continued)

(56) References Cited

U.S. PATENT DOCUMENTS 2,271,911 A * 2/1942 Brisbane ..... G05D 7/0635 200/81.5
3,168,049 A 2/1965 Taylor et al.
(Continued)

FOREIGN PATENT DOCUMENTS

GB 2332690 A 6/1999
RU 2232245 C1 7/2004
(Continued)

OTHER PUBLICATIONS

"U.S. Appl. No. 14/423,833, Advisory Action dated May 10, 2016", 3 pgs.
(Continued)

*Primary Examiner* — George S Gray
(74) *Attorney, Agent, or Firm* — Chamberlain Hrdlicka

(57) ABSTRACT

An apparatus and a system, as well as a method and an article, may include operating a positive displacement motor having a pair of output orifices including a selectably movable outer output orifice disposed proximate to a fixed inner output orifice. Operation may include rotating the outer output orifice about the longitudinal axis of the motor when drilling fluid is flowing through the pair of orifices to control fluid pressure pulse amplitude from the outer output orifice. Additional apparatus, systems, and methods are disclosed.

21 Claims, 6 Drawing Sheets

(51) Int. Cl.

| | |
|---|---|
| ***E21B 47/18*** | (2012.01) |
| ***E21B 47/16*** | (2006.01) |
| ***E21B 4/02*** | (2006.01) |
| ***E21B 21/08*** | (2006.01) |
| ***E21B 21/10*** | (2006.01) |
| ***E21B 28/00*** | (2006.01) |

(52) U.S. Cl.
CPC ..... *E21B 21/08* (2013.01); *E21B 21/10* (2013.01); *E21B 28/00* (2013.01); *E21B 47/16* (2013.01)

(58) Field of Classification Search
CPC ..... E21B 21/10; E21B 4/02; E21B 31/005; B06B 1/18–1/20
See application file for complete search history.

(56) References Cited

U.S. PATENT DOCUMENTS

| | | | | |
|---|---|---|---|---|
| 3,994,166 | A * | 11/1976 | Dower | E21B 21/08 73/716 |
| 4,544,041 | A | 10/1985 | Rinaldi | |
| 4,676,725 | A | 6/1987 | Eppink | |
| 4,734,892 | A | 3/1988 | Kotlyar | |
| 4,890,682 | A | 1/1990 | Worrall et al. | |
| 4,914,637 | A * | 4/1990 | Goodsman | E21B 47/18 367/83 |
| 5,211,842 | A * | 5/1993 | Tuss | B01D 19/0015 166/75.12 |
| 5,265,682 | A * | 11/1993 | Russell | E21B 4/02 175/45 |
| 5,495,900 | A | 3/1996 | Falgout, Sr. | |
| 5,568,448 | A | 10/1996 | Tanigushi et al. | |
| 5,836,353 | A | 11/1998 | Van Steenwyk | |
| 5,996,687 | A * | 12/1999 | Pringle | E21B 34/06 137/599.17 |
| 6,009,948 | A | 1/2000 | Flanders et al. | |
| 6,094,401 | A | 7/2000 | Masak et al. | |
| 6,279,670 | B1 | 8/2001 | Eddison et al. | |
| 6,439,318 | B1 | 8/2002 | Eddison et al. | |
| 6,508,317 | B2 | 1/2003 | Eddison et al. | |
| 7,082,078 | B2 | 7/2006 | Fripp et al. | |
| 7,082,821 | B2 | 8/2006 | Chen et al. | |
| 7,413,416 | B2 | 8/2008 | Bratu | |
| 7,870,900 | B2 | 1/2011 | Dorado | |
| 7,921,937 | B2 | 4/2011 | Brackin et al. | |
| 8,083,508 | B2 | 12/2011 | Irving et al. | |
| 2002/0148606 | A1 | 10/2002 | Zheng et al. | |
| 2002/0157871 | A1 | 10/2002 | Tulloch | |
| 2004/0156265 | A1 | 8/2004 | Lavrut | |
| 2005/0178558 | A1 | 8/2005 | Kolle et al. | |
| 2005/0194183 | A1 | 9/2005 | Gleitman | |
| 2005/0271535 | A1 | 12/2005 | Katz | |
| 2006/0272821 | A1 | 12/2006 | Webb | |
| 2007/0187112 | A1* | 8/2007 | Eddison | E21B 1/005 166/380 |
| 2007/0289778 | A1 | 12/2007 | Watkins et al. | |
| 2008/0073077 | A1 | 3/2008 | Tunc et al. | |
| 2008/0251254 | A1 | 10/2008 | Lynde et al. | |
| 2009/0152009 | A1* | 6/2009 | Slay | C08K 5/549 175/107 |
| 2009/0223676 | A1 | 9/2009 | Eddison et al. | |
| 2010/0188253 | A1* | 7/2010 | Shearer | E21B 47/18 340/853.3 |
| 2010/0212900 | A1 | 8/2010 | Eddison et al. | |
| 2011/0056695 | A1 | 3/2011 | Downton | |
| 2011/0069583 | A1 | 3/2011 | Camwell et al. | |
| 2011/0127044 | A1 | 6/2011 | Radford | |
| 2012/0188678 | A1 | 7/2012 | Harwath et al. | |
| 2012/0211251 | A1* | 8/2012 | Konschuh | E21B 28/00 173/201 |
| 2012/0305244 | A1 | 12/2012 | Atkinson et al. | |
| 2015/0337652 | A1 | 11/2015 | Rodney | |

FOREIGN PATENT DOCUMENTS

| | | | |
|---|---|---|---|
| RU | 67177 | U1 | 10/2007 |
| SU | 673765 | A | 7/1979 |
| WO | WO-9612893 | A1 | 5/1996 |
| WO | WO-2011058307 | A2 | 5/2011 |
| WO | WO-2014081416 | A1 | 5/2014 |
| WO | WO-2014081417 | A1 | 5/2014 |

OTHER PUBLICATIONS

"U.S. Appl. No. 14/423,833, Final Office Action dated Feb. 25, 2016", 18 pgs.
"U.S. Appl. No. 14/423,833, Non Final Office Action dated Oct. 7, 2015", 17 pgs.
"U.S. Appl. No. 14/423,833, Preliminary Amendment dated Feb. 25, 2015", 7 pgs.
"U.S. Appl. No. 14/42 833, Response filed Feb. 1, 2016 to Non Final Office Action dated Oct. 7, 2015", 14 pgs.
"U.S. Appl. No. 14/423,833, Response filed Apr. 14, 2016 to Final Office Action dated Feb. 25, 2016", 10 pgs.
"Australian Application Serial No. 2012394944, First Examiner Report dated Dec. 5, 2015", 3 pgs.
"Australian Application Serial No. 2012394944, Request and First Statement of Proposed Amendments filed on Mar. 2, 2016 in response to First Examiner Report dated Dec. 5, 2015", 55 pgs.
"Canadian Application Serial No. 2,890,072, Office Action dated May 11, 2016", 6 pgs.
European Search Report and Written Opinion issued in corresponding application No. EP 12 88 8817, dated Sep. 16, 2016, 8 pgs.
Australian Application Serial No. 2012394943, Notice of Acceptance dated May 18, 2015, 6 pgs.
"International Application Serial No. PCT/US2012/066077, Corrected International Search Report dated May 8, 2013", 4 pgs.
"International Application Serial No. PCT/US2012/066077, Corrected Written Opinion dated May 8, 2013", 4 pgs.
"International Application Serial No. PCT/US2012/066077, International Preliminary Report on Patentability dated Jun. 4, 2015", 6 pgs.
"International Application Serial No. PCT/US2012/066094, International Preliminary Report on Patentability dated Mar. 2, 2015", 8 pgs.
"International Application Serial No. PCT/US2012/066094, Response filed Jul. 16, 2014 to Written Opinion dated May 9, 2013", 3 pgs.
"International Application Serial No. PCT/US2012/066077, International Search Report dated May 8, 2013", 4 pgs.
"International Application Serial No. PCT/US2012/066077, Written Opinion dated May 8, 2013", 4 pgs.
"International Application Serial No. PCT/US2012/066094, International Search Report dated May 9, 2013".
"International Application Serial No. PCT/US2012/066094, Written Opinion dated May 9, 2013".
Finger, J. T, et al., "Development plan for an advanced drilling system with real-time diagnostics (Diagnostics-While-Drilling)", Sandia Report, SAND2000-0239, (Feb. 2000), 65 pgs.
Meehan, R. J, et al., "Drill Bit Seismic: A Drilling Optimization Tool", IADC/SPE Drilling Conference, Mar. 3-6, 1998, Dallas, Texas, IADC/SPE 39312, (1998), 177-190.
Soufi, Naser, "Shale Pressure Measurements Methods", NTNU, Det skapende universitet, http://www.ipt.ntnu.no/~ norne/wiki/data/media/english/thesis/naser-soufi.pdf,(2009), 148 pgs.
"European Application Serial No. 12888817.9, Office Action dated Jul. 1, 2015", 2 pgs.
"European Application Serial No. 12888817.9, Response filed Sep. 9, 2015 to Office Action dated Jul. 1, 2015", 10 pgs.
U.S. Appl. No. 14/423,833, filed Feb. 25, 2015, Acoustic Signal Enhancement Apparatus, Systems, and Methods.

* cited by examiner

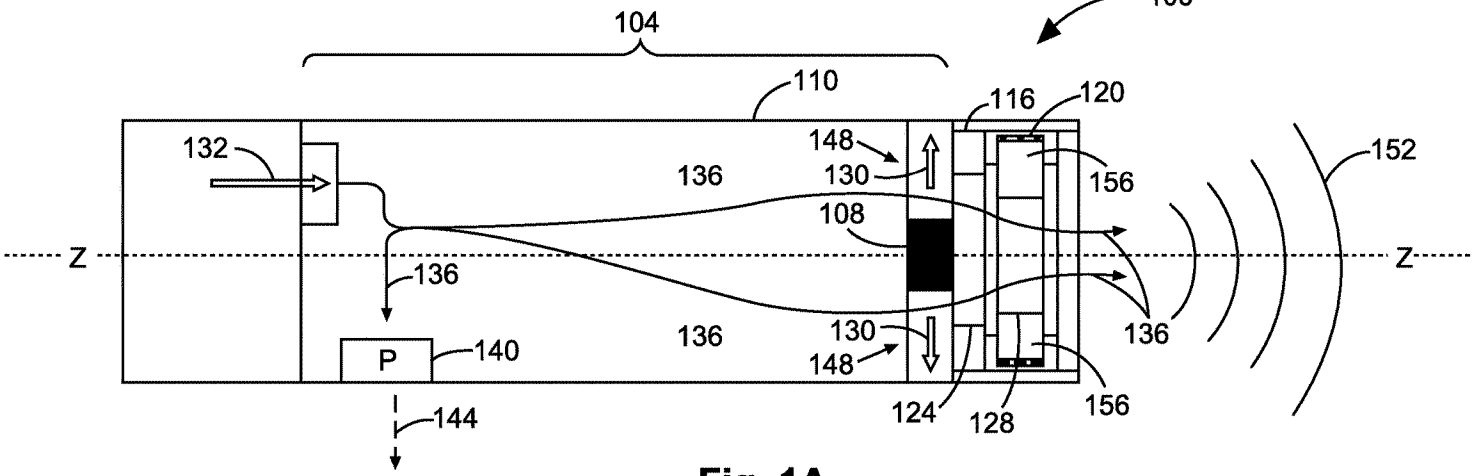
Fig. 1A
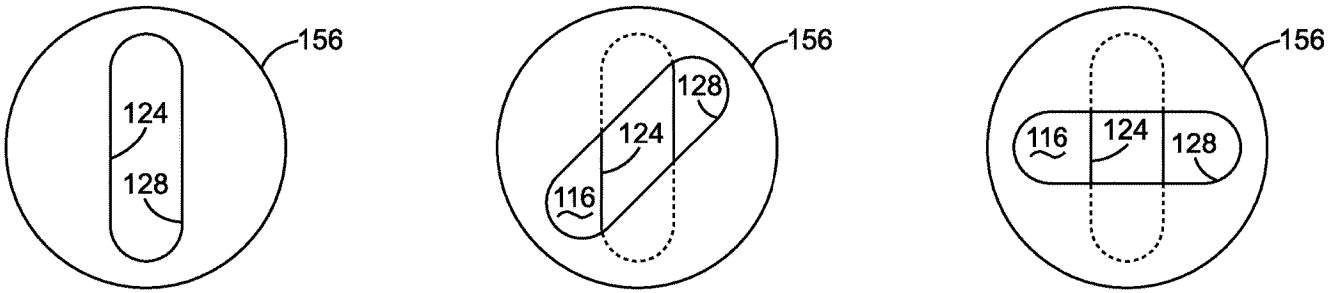
Fig. 1B
Fig. 1C
Fig. 1D

DYNAMIC AGITATION CONTROL APPARATUS, SYSTEMS, AND METHODS

PRIORITY APPLICATIONS

This application is a U.S. National Stage Filing under 35 U.S.C. 371 from International Application No. PCT/US2012/066094, filed on 20 Nov. 2012, and published as WO 2014/081417 A1 on 30 May 2014, which applications and publication are incorporated herein by reference in their entirety.

BACKGROUND

Moineau motors, in the form of mud motors, have been used for decades to provide power in straight hole and directional drilling operations. In some cases, such as during horizontal drilling, the motion of a Moineau motor powered by drilling fluid, or mud, is used to agitate the drill string to reduce sticking and friction, increasing drilling efficiency. However, the vibrations produced during Moineau motor operations can interfere with signal acquisition, including surveying and mud pulse telemetry activities.

BRIEF DESCRIPTION OF THE DRAWINGS

FIG. 1A is a side, cut-away view, and FIGS. 1B-1D are frontal views of a positive displacement motor, such as a Moineau motor, forming part of an apparatus configured according to various embodiments of the invention.

DETAILED DESCRIPTION

Figure 3:
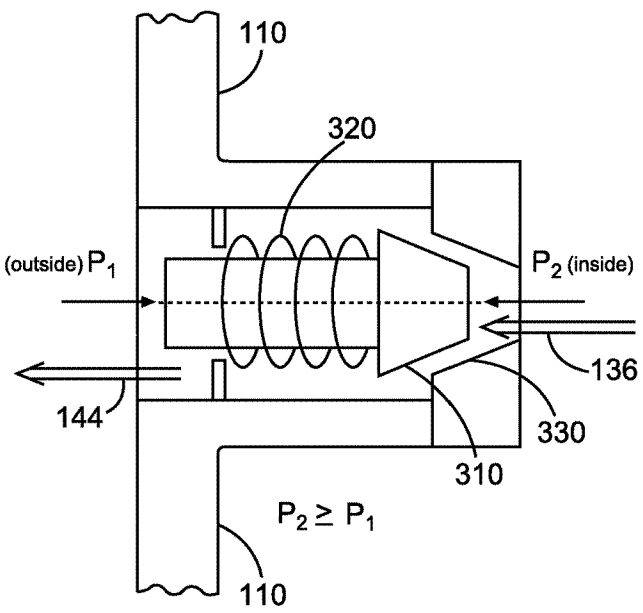
FIG. 3 is a side, cut-away view of a metering piston assembly, according to various embodiments of the invention.

In various embodiments, the invention provides a mechanism for dynamically controlling a drillstring agitator, powered by a positive displacement motor, such as a Moineau motor. Dynamic control may consist simply of rendering the agitator active or inactive, or it may involve changing the amplitude of the vibrations produced by the agitator. The provision of dynamic control enables selectable agitation, to avoid interfering with mud pulse telemetry activity, for example. There may also be conditions under which it is desirable to activate the agitator only when there is evidence of stick/slip. Various other benefits may accrue.

For the purposes of this document, a "Moineau motor" comprises a progressive cavity, positive displacement motor. The term "positive displacement motor" includes both a Moineau motor and a progressive cavity motor. Thus, while the term "Moineau motor" is used throughout this document for reasons of convenience and simplicity, the terms "positive displacement motor" and "progressive cavity motor" may be substituted for the term "Moineau motor" in every case. In this way, it can be understood that the description that follows is not limited to the particular instance of using a Moineau motor only.

During down hole operations, when drilling fluid, or mud, flows into a Moineau motor, eccentric motion of the rotor is initiated, which can then be transferred to other components, either directly or indirectly, via fluid pressure pulses. Different rotor and stator configurations (e.g., changing the number of lobes on the rotor) can be used to provide increased power. In many embodiments, a Moineau motor is used as an "agitator" to induce vibration in the drill string.

FIG. 1A is a side, cut-away view, and FIGS. 1B-1D are frontal views of a positive displacement motor 104, such as a Moineau motor, forming part of an apparatus 100 that is configured according to various embodiments of the invention. When used as an agitator, the Moineau motor 104 accepts drilling fluid 132, directing the flow 136 of the fluid toward an inner output orifice 124 that is formed into an inner orifice plate 116. As the rotor 108 of the Moineau motor 104 moves eccentrically up and down (as seen from the side), the center of the flow 136 exiting the motor 104 also moves.

The flow 136 is initially directed against the inner orifice plate 116, and the inner output orifice 124. The varying position of the flow 136 with respect to the inner output orifice 124 results in pressure fluctuations. These fluctuations produce pressure pulses 152, which can be used to vibrate the drillstring.

One of the mechanisms that can be used to control the output of the Moineau motor 104 is that of augmenting the inner orifice plate 116, which is fixed, with a rotatable outer orifice plate 156 that includes an outer output orifice 128. The outer output orifice 128 may have a shape that is similar to or identical to that of the inner output orifice 124.

By changing the position of the outer orifice plate 156, and thus the outer output orifice 128 with respect to the fixed inner output orifice 124, the amplitude of fluid pressure pulses 152 emanating from the apparatus 100 can be controlled dynamically. As can be seen in FIGS. 1B-1D, the outer output orifice 128 can be positioned as desired with respect to the inner output orifice 124, so that a maximum amount of flow is allowed (FIG. 1B), or something less than the maximum flow (FIG. 1C), or even a minimum amount of flow (FIG. 1D), which occurs when the outer output orifice 128 provides the greatest amount of occlusion to the flow 136 that passes through the inner output orifice.

The specific manner in which the outer orifice plate 156 is attached to the Moineau motor 104 depends on the application. For example, one way of mounting the rotatable outer orifice plate 156 is to use a bearing 120 that circumscribes the opening at the output of the Moineau motor 104. The bearing 120 can be retained in an extension of the Moineau motor housing 110. Other methods may be used to mount the outer orifice plate 156 to the motor 104, such as threaded enclosures or pinned housings.

Figure 2:
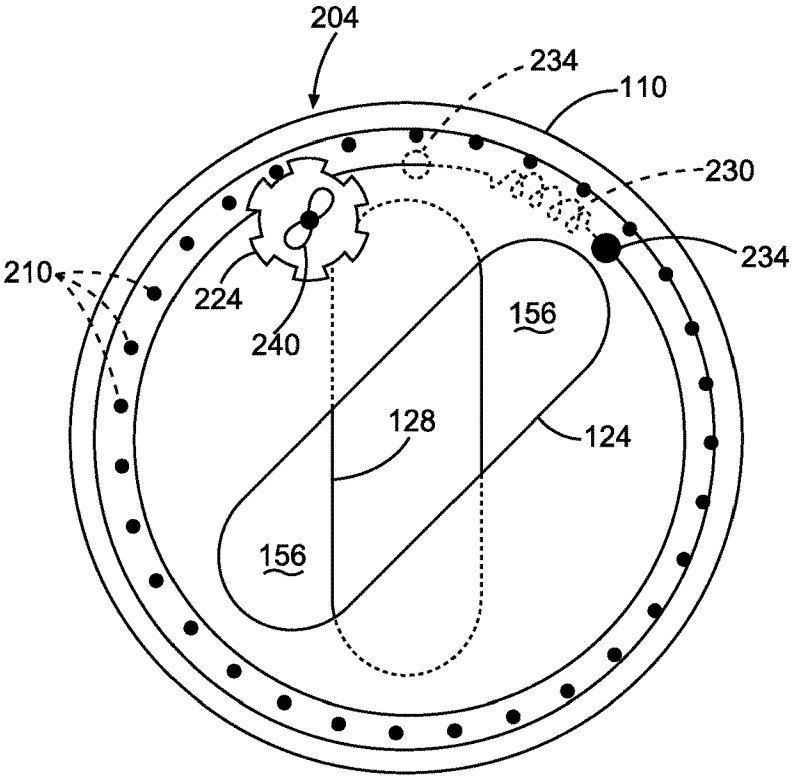
FIG. 2 is a rear view of inner and outer orifices, with a gear drive and spring used to control rotation of the outer orifice, in an apparatus configured according to various embodiments of the invention.

FIG. 2 is a rear view of inner and outer orifices 124, 128, with a gear drive 204 and spring 230 used to control rotation of the outer output orifice 128, in an apparatus 100 configured according to various embodiments of the invention. More specifically, the drive 204 and spring 230 can be used to control rotation of the outer orifice plate 156, into which the outer output orifice 128 is formed.

For example, it may be desirable to stop agitation at certain times, such as during a stationary survey. The problem addressed in this case is that mud flow is maintained while surveying even though the drill bit isn't advancing.

This is done in order to keep the drillstring from sticking. The apparatus to stop the agitator is activated by briefly interrupting the flow, or by greatly reducing the flow.

One class of mechanisms for bringing about this effect includes a spring 230 (e.g., an extension or coil spring) that is anchored on each end by a pair of pins 234, with one end attached to the housing 110 of the Moineau motor 104, and the other end attached to the rotatable outer orifice plate 156. The motion of the outer output orifice 128 is somewhat constrained in this way, and the mechanism is designed so that when no external torque is acting on the rotatable outer output orifice 128, it is substantially aligned with the fixed inner output orifice 124 of the apparatus 100.

An impeller 240 can be mounted to the gear drive 204, perhaps on a shaft (not shown) coupled to a gear 224 that engages with teeth 210 on the rotatable outer orifice plate 156. The impeller 240 thus can be used to rotate the gear 224. The shaft of the gear drive may be mounted to the housing 110 in any number of conventional ways.

During operation, when the flow of drilling fluid begins to enter the housing 110, the outer output orifice 128 is aligned with the inner output orifice 124 (see FIG. 1B). As the flow increases, the impeller 240 turns, which turns the gear 224. The gear 224 engages the teeth 210, to rotate the outer orifice plate 156 (see FIG. 1C) until the plate 156 reaches a stop at the position where the outer output orifice 128 is substantially orthogonal to the inner output orifice 124 (see FIG. 1D). This action increases the amplitude of the pressure pulses 152 to a maximum value when there is sufficient fluid flow 136 to hold the outer orifice plate 156 in the position shown in FIG. 1D. As the flow 136 is reduced, the outer orifice plate 156 will tend to return to the position shown in FIG. 1B.

Another mechanism to mechanically control the movement of the outer orifice plate 156 involves metering the flow of the drilling fluid based on the pressure differential between the outside of the housing 110 and the inside of the housing 110. In this case, a metering piston assembly 140 might be used.

For example, FIG. 3 is a side, cut-away view of a metering piston assembly 140, according to various embodiments of the invention. The piston 310 within the metering piston assembly 140 is actuated using differential pressure $\Delta P = P2 - P1$. Referring now to FIGS. 1A and 3, it can be seen that when the pressure P2 inside the housing 110 becomes greater than the pressure P1 outside the housing (so that the flow pressure against the face of the piston 310 can overcome the pressure exerted outside the housing 110, added to the force of the seating spring 320), the metering piston assembly 140 is activated. Under these conditions, the piston 310 is unseated to divert some of the flow 136 past the metering opening 330, to the outside of the housing 110, as diverted flow 144. As a result, the amplitude of the pressure pulses 152 is reduced.

A piston metering assembly 140 can also be used in conjunction with the gear drive 204 and spring 230 mechanism. In this case, if the gear drive 224 is carried in a separate compartment within the housing 110, for example, differential pressure $\Delta P = P2 - P1$ can be used to meter fluid into the compartment, to drive the impeller 224, or out of the compartment, to stop the motion of the drive 204.

The advantage to these mechanisms is that they do not use electronic control, or communication with other parts of the drilling system. The level of vibration can be moderated to any desired degree, so that the amount and/or timing of agitation is high enough to prevent stick-slip under most conditions, and low enough to reduce interference with survey data acquisition.

The apparatus 100 can also be actuated on command, so that agitation can be started and stopped whenever such is desired. For example, if a battery, electronics, and a telemetry link are mounted in the housing 110 of the Moineau motor 104 or in an extension to its housing, then it is possible to control agitation operations from outside of the apparatus 100. For example, a short hop electromagnetic telemetry link (e.g., a telemetry link implemented according to the Institute of Electrical and Electronic Engineers standard 1902.1—"IEEE Standard for Long Wavelength Wireless Network Protocol", 2009) could be used to send commands to regulate the operation of the apparatus 100.

For this mode of operation, upon receipt of a command, an electrical motor (used in place of the impeller 240) could be used to drive the gear 224, moving the outer output orifice 128 to align with the inner output orifice 124, reducing the amplitude of the pressure pulses 152. Similarly, the outer output orifice 128 could be commanded to move to any desired position with respect to the inner output orifice 124, increasing or decreasing the amplitude of the pressure pulses 152. This mechanism could be used to reduce the level of agitation provided by the apparatus 100 on command, which might be of benefit during mud pulse telemetry system operations. It may also be useful to stop agitation during periods when there is no concern about stick/slip of the associated drillstring.

Figure 4:
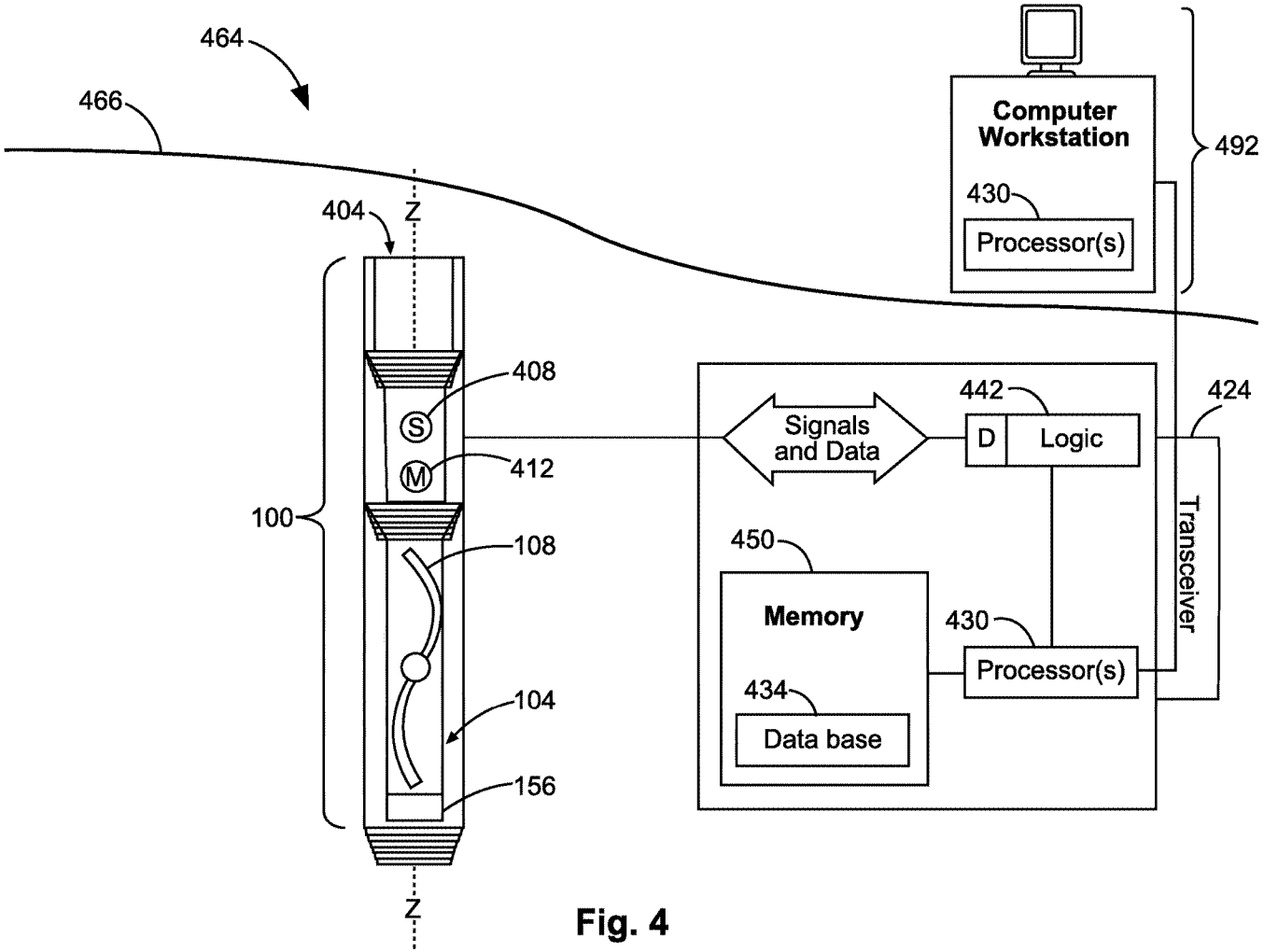
FIG. 4 illustrates apparatus and systems according to various embodiments of the invention.

FIG. 4 illustrates apparatus 100 and systems 464 according to various embodiments of the invention. In some embodiments, a flow meter 412 and or other electronic controls can be used in conjunction with the apparatus 100. For example, in some cases, a locking mechanism 408 can be added to the apparatus 100. The locking mechanism 408 can be controlled by the flow meter 412. Once a selected quantity of flow ceases to pass through the flow meter 412, the locking mechanism 408 can be operated to lock the rotor 108 of the motor 104, halting agitation. A time delay can also be implemented to coincide with LWD/MWD (logging while drilling/measurement while drilling) system operations, to allow sufficient time for data to be transmitted to the surface via mud pulse telemetry. Once a selected quantity of flow again passes through the flow meter 412, the locking mechanism 408 can be operated to release the rotor 108 of the motor 104, allowing agitation to resume. Again, a time delay can be implemented to coincide with various system operations, to allow sufficient time for data transmission or reception, or other activities which might be sensitive to the vibrations of agitation.

A locking mechanism 408 may comprise a ball drop, locking blocks, and other types of mechanisms that are known to those of ordinary skill in the art. The locking mechanism 408 can be activated mechanically and/or electrically.

Referring now to FIGS. 1-4, it can be seen that the meter 412 can be used to control movement of the outer orifice plate 156, or a metering piston 310. In this way, the magnitude of pressure pulses 152 can be regulated. That is, once a sufficient flow of drilling fluid had been measured by the meter 412, the outer output orifice 128 can be substantially aligned with the inner output orifice 124 to maximize the pressure pulse amplitude.

An MWD/LWD bus master could also be used to electronically control the operation of the locking mechanism 408 in some embodiments. If the apparatus 100 is far from any down hole power source, an electronic control system can be utilized, such as a battery sub (not shown), wiring, and a processor, to control flow diversion and/or rotor locking within the apparatus 100.

With mechanical or electronic control of the position of the output orifice plate 156 (and thus, the outer output orifice 128), activation, control, and deactivation of the agitation apparatus 100 can be automated. For example, the apparatus 100 can be used as an agitator, activated when stick-slip is detected in an associated drill string. Stick-slip can be detected in a number of ways, such as detecting mud pressure variations, a change in the weight-on-bit, a change in the bending moment experienced by the bottom hole assembly (BHA), and/or variations in the inclination detected by an at-bit inclination (ABI) sensor.

Once stick-slip is detected, there are various ways to implement automated actuation of an agitator mechanism, as provided by the apparatus 100. For example, on-board signal processing can be used to detect stick-slip conditions using weight on bit and/or ABI data, followed by processor-based feedback control of agitation (via rotation of the outer orifice plate 156).

Thus, in some embodiments, an apparatus 100 that operates in conjunction with the system 464 may comprise a down hole tool 404 (e.g., that includes a battery sub, an MWD sub, etc.) with one or more Moineau motors 104 (having fluid pressure pulse amplitude controlled via the operation of a movable outer orifice plate 156), locking mechanisms 408, and meters 412.

The system 464 may include logic 442, perhaps comprising an outer orifice plate control system. The logic 442 can be used to acquire pressure information, flow metering information, and position information related to the location of the outer output orifice 128 with respect to the inner output orifice 124.

The system 464, and/or any of its components, may be located down hole, perhaps in a down hole tool 404, or at the surface 466, perhaps as part of a computer workstation forming part of a surface logging facility 492.

In some embodiments of the invention, the system 464 may operate to acquire signals and data, and to transmit them to the surface 466 and/or use them directly to control operation of the apparatus 100. Processors 430 may operate on signals and data that are acquired by the apparatus 100, perhaps from a meter 412. The acquired signals and data can be stored in a memory 450, perhaps in the form of a database 434. The operation of the processors 430 may also result in the determination of various properties of the formation surrounding the tool 404, as well as transmitting commands to lock/unlock the rotor 108 of the motor 104.

Thus, referring now to FIGS. 1-4, it can be seen that many embodiments may be realized. For example, an apparatus 100 may comprise a Moineau motor 104 with two output orifices 124, 128, the outer output orifice 128 (e.g., formed in the plate 156) being movable.

In some embodiments, an apparatus 100 comprises a Moineau motor 104 and a pair of output orifices 124, 128 attached to a fluid output port 148 of the motor 104. The pair of output orifices 124, 128 comprise a selectably movable outer output orifice 128 disposed proximate to a fixed inner output orifice 124, wherein the amplitude of fluid pressure pulses 152 from the outer output orifice 128 is controllable by rotating the outer output orifice 128 about the longitudinal axis Z of the motor 104 when drilling fluid 132 is flowing through the pair of orifices 124, 128.

The output orifices 124, 128 may have a "similar" opening configuration, which means the orifices 124, 128 comprise openings of at least the same shape or the same size (e.g., they have the same amount of opening area). The orifices may also be "identical" in their opening configuration, which means the orifices 124, 128 comprise openings that have both the same shape and the same size.

A spring may be used to restrain the movement of the movable output orifice, returning it to the original position when there is no flow. Hence, when the flow resumes, the apparatus 100, operating as an agitator, will be inactive for the period of time that it takes to resume flow of the drilling fluid 132 to move the outer output orifice 128 against the spring 230, away from its "original" position, which is defined herein to be a fully open position (see FIG. 1B). Thus, the apparatus 100 may comprise a spring 230 to return the outer output orifice 128 to an "inactive" position, defined herein to be a fully closed position (see FIG. 1D), when flow 136 of the drilling fluid 132 is reduced below some selected lower limit.

In some embodiments, the movable outer output orifice may have a variety of shapes. Thus, the outer output orifice 128 may be formed as one of a stadium, an ellipse, or a circle, among other shapes.

In some embodiments, a bearing may be used to support the movable outer output orifice as it rotates about the longitudinal axis of the motor. Thus, the apparatus 100 may comprise a bearing 120 circumscribing the fluid output port 148, wherein the outer output orifice 128 is attached to rotate against the bearing 120.

In some embodiments, a gear drive system may be used to rotate the movable outer output orifice. Thus, the apparatus 100 may comprise a gear drive 204 system to couple a plate 156 containing the outer output orifice 128 to a housing 110 of the motor 104, and to permit selective positioning of the outer output orifice 128 with respect to the inner output orifice 124 during operation of the motor 104.

In some embodiments, the driving force for the gear may be provided by an impeller. The, the apparatus 100 may comprise an impeller 240 disposed in a drilling fluid path within the motor 104, the impeller 240 to provide motive force to the gear drive 204 system.

In some embodiments, a metering piston may be used to control the entry of fluid into the motor, based on a pressure difference across the motor housing. Thus, the apparatus 100 may comprise a metering piston 310 to control fluid flow through the motor 104, based on a pressure difference between the inside of the motor housing 110, and the outside of the motor housing 110.

In some embodiments, the movable outer output orifice can be positioned under electronic control. Thus, the apparatus 100 may comprise an electronic controller (e.g., perhaps in the form of logic 442 and/or processors 430) to receive commands and to control positioning of the outer output orifice 128 with respect to the inner output orifice 124 during operation of the motor 104.

Various embodiments of systems 464 may also be realized. for example, a system 464 may comprise a Moineau motor 104 that has a movable outer output orifice 128, and a down hole transmitter (e.g., perhaps included in the transceiver 424) and/or sensor (e.g., perhaps in the form of a meter 412, or an MWD acoustic formation sensor). For example, in some embodiments, a system 464 comprises at least one of a fluid pulse telemetry transmitter (e.g., included in or separated from the transceiver 424) or a down hole sensor (e.g., the meter 412) and a Moineau motor 104. The motor 104 is configured with a pair of output orifices 124, 128 as described previously. In this case, the fluid pressure pulse amplitude from the outer output orifice 128 is controllable by rotating the outer output orifice 128 about the longitudinal axis Z of the motor 104 when drilling fluid 132 is flowing through the pair of orifices 124, 128, to reduce the fluid pressure pulse amplitude during some portion of the operational time of the transmitter or the sensor, or both.

In some embodiments, fluid flow quantity can be measured, and used to lock the motor and/or control the movable orifice, to reduce pulse amplitude, providing a more hospitable environment for telemetry and formation property measurement. Thus, an apparatus 100 and system 464 may comprise a flow meter 412 to measure flow of the drilling fluid 132, and to enable locking movement of the motor 104 or controlled movement of the outer output orifice 128 to reduce the fluid pressure pulse amplitude.

In some embodiments, electronic control can be used in addition, or alternatively, to lock the motor and/or control the movable orifice, to moderate pulse amplitude. Thus, an apparatus 100 and system 464 may comprise an electronic controller (e.g., the logic 442, the processors 430, or both) to receive commands and to enable lockable movement of the motor 104 (e.g., via locking and unlocking the rotor 108) or controlled movement of the outer output orifice 128 to reduce the fluid pressure pulse amplitude.

In some embodiments, commands to lock, unlock, or rotate are provided by a module configured to monitor flow of the drilling fluid or differential pressure across a housing of the motor. The module may take the form of the logic 442, or one or more processors 430 programmed to implement reception and execution of the commands delivered to the agitation apparatus 100.

In some embodiments, a spring, gears, or an electronic controller can be used to adjust the amount of time it takes to move the outer orifice from a fully open position, to a fully closed position, with respect to the inner output orifice, as fluid flow into the motor increases from low or no flow, to relatively high flow. Thus, the apparatus 100 and the system 464 may comprise a mechanical or electronic delay mechanism D (e.g., perhaps a timer included as part of the logic 442) to set a delay period for moving the outer output orifice 128 from a position of substantial alignment with the inner output orifice 124 (see FIG. 1B) to substantial non-alignment with the inner output orifice (see FIGS. 1C-1D) as the flow rate of the drilling fluid 132 changes from a lower flow rate to a higher flow rate. Still further embodiments may be realized.

Figure 5:
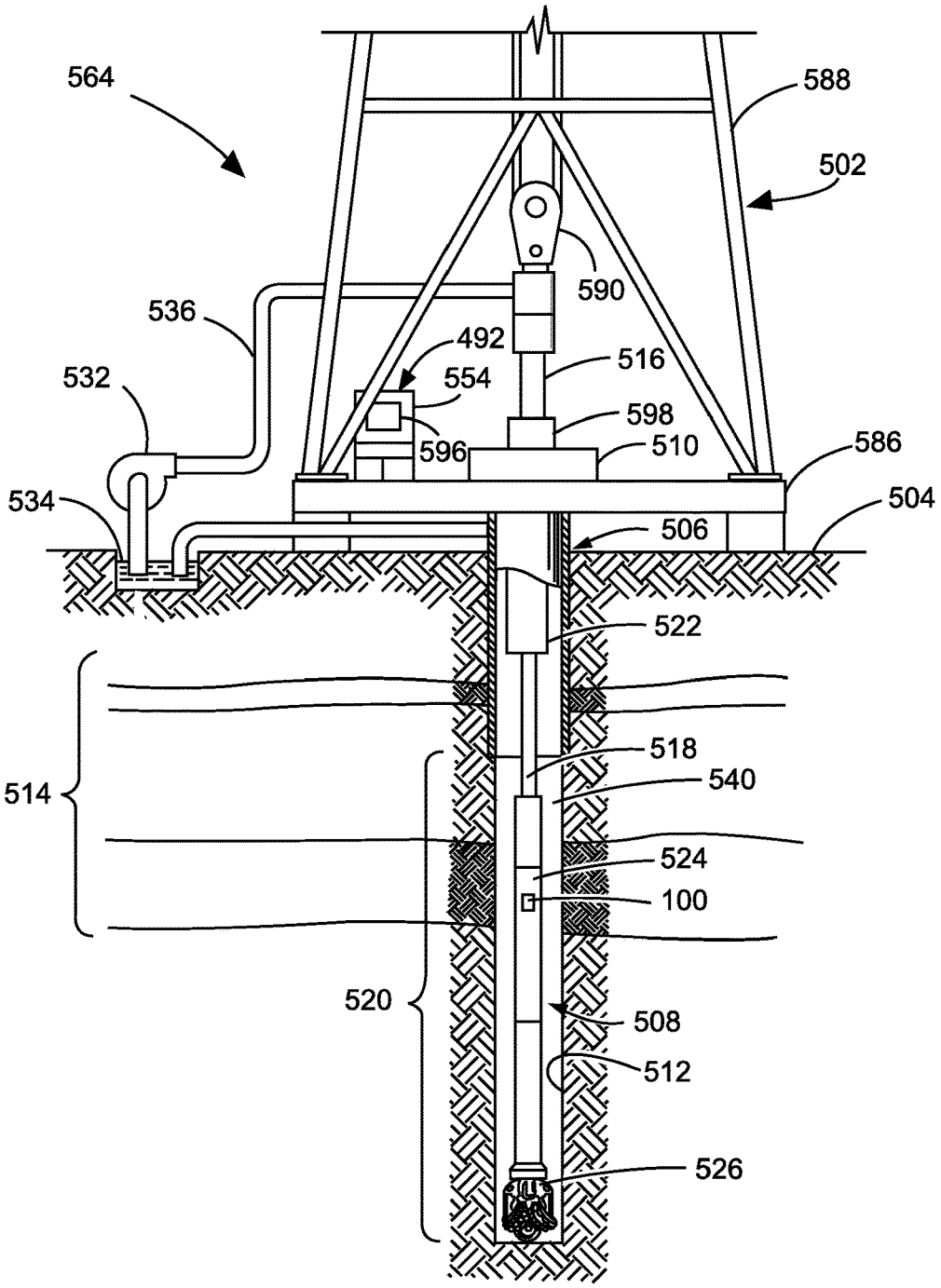
FIG. 5 illustrates a while-drilling system embodiment of the invention.

For example, FIG. 5 illustrates a while-drilling system 564 embodiment of the invention. The system 564 may comprise portions of a down hole tool 524 as part of a down hole drilling operation.

The drilling of oil and gas wells is commonly carried out using a string of drill pipes connected together so as to form a drilling string 508 that is lowered through a rotary table 510 into a wellbore or borehole 512. Here a drilling platform 586 is equipped with a derrick 588 that supports a hoist 590 to raise and lower the string 508.

A drilling rig 502 is located at the surface 504 of a well 506. The drilling rig 502 may provide support for a drill string 508, via the hoist 590. The drill string 508 may operate to penetrate a rotary table 510 for drilling a borehole 512 through subsurface formations 514. The drill string 508 may include a Kelly 516, drill pipe 518, and a bottom hole assembly 520, perhaps located at the lower portion of the drill pipe 518.

The bottom hole assembly 520 may include drill collars 522, a down hole tool 524, and a drill bit 526. The drill bit 526 may operate to create the borehole 512 by penetrating the surface 504 and subsurface formations 514. The down hole tool 524 may comprise any of a number of different types of tools including MWD tools, LWD tools, and others.

During drilling operations, the drill string 508 (perhaps including the Kelly 516, the drill pipe 518, and the bottom hole assembly 520) may be rotated by the rotary table 510. In addition to, or alternatively, the bottom hole assembly 520 may also be rotated by a motor (e.g., a mud motor) that is located down hole. The drill collars 522 may be used to add weight to the drill bit 526. The drill collars 522 may also operate to stiffen the bottom hole assembly 520, allowing the bottom hole assembly 520 to transfer the added weight to the drill bit 526, and in turn, to assist the drill bit 526 in penetrating the surface 504 and subsurface formations 514.

During drilling operations, a mud pump 532 may pump drilling fluid (sometimes known by those of skill in the art as "drilling mud") from a mud pit 534 through a hose 536 into the drill pipe 518 and down to the drill bit 526. The drilling fluid can flow out from the drill bit 526 and be returned to the surface 504 through an annular area 540 between the drill pipe 518 and the sides of the borehole 512. The drilling fluid may then be returned to the mud pit 534, where such fluid is filtered. In some embodiments, the drilling fluid can be used to cool the drill bit 526, as well as to provide lubrication for the drill bit 526 during drilling operations. Additionally, the drilling fluid may be used to remove subsurface formation cuttings created by operating the drill bit 526.

Thus, referring now to FIGS. 1-5, it may be seen that in some embodiments, a system 564 may include a down hole tool 404, 524 to house one or more apparatus 100 and/or systems 464, similar to or identical to the apparatus and systems described above and illustrated in FIGS. 1-4. Many embodiments may thus be realized.

In some embodiments, a system 464, 564 may include a display 596 to present the information provided by the meter 412, and other information regarding the state of the apparatus 100, including the position of the outer output orifice 128, perhaps in graphic form. A system 464, 564 may also include computation logic, perhaps as part of a surface logging facility 492, or a computer workstation 554, to receive signals from logic 442 and/or processors 430 located down hole to determine adjustments to be made to the position of the outer output orifice 128 of the apparatus 100.

The apparatus 100; motor 104; rotor 108; housing 110; inner orifice plate 116; inner output orifice 124; outer output orifice 128; drilling fluid 132; flow 136; diverted flow 144; fluid output port 148; fluid pressure pulses 152; outer orifice plate 156; drive 204; teeth 210; gear 224; springs 230, 320; pins 234; impeller 240; piston 310; metering opening 330; down hole tools 404, 524; locking mechanism 408; flow meter 412; transceiver 424; processors 430; database 434; logic 442; memory 450; systems 464, 564; surfaces 466, 504; logging facility 492; drilling rig 502; well 506; drill string 508; rotary table 510; borehole 512; formations 514; Kelly 516; drill pipe 518; bottom hole assembly 520; drill collars 522; drill bit 526; mud pump 532; mud pit 534; hose 536; workstation 554; platform 586; derrick 588; hoist 590; display 596; and pressures P1, P2 may all be characterized as "modules" herein.

Such modules may include hardware circuitry, a processor, memory circuits, software program modules and objects, firmware, and/or combinations thereof, as desired by the architect of the apparatus 100 and systems 464, 564, and as appropriate for particular implementations of various embodiments. For example, in some embodiments, such modules may be included in an apparatus and/or system operation simulation package, such as a software electrical signal simulation package, a communications simulation package, a power distribution simulation package, a power/heat dissipation simulation package, and/or a combination of software and hardware used to simulate the operation of various potential embodiments.

It should also be understood that the apparatus and systems of various embodiments can be used in applications other than for drilling operations, and thus, various embodiments are not to be so limited. The illustrations of apparatus 100 and systems 464, 564 are intended to provide a general understanding of the structure of various embodiments, and they are not intended to serve as a complete description of all the elements and features of apparatus and systems that might make use of the structures described herein.

Applications that may include the novel apparatus and systems of various embodiments may include electronic circuitry used in high-speed computers, communication and signal processing circuitry, modems, processor modules, embedded processors, data switches, application-specific modules, or combinations thereof. Such apparatus and systems may further be included as sub-components within a variety of electronic systems, such as televisions, cellular telephones, personal computers, workstations, radios, video players, vehicles, signal processing for geothermal tools and smart transducer interface node telemetry systems, among others. Some embodiments include a number of methods.

Figure 6:
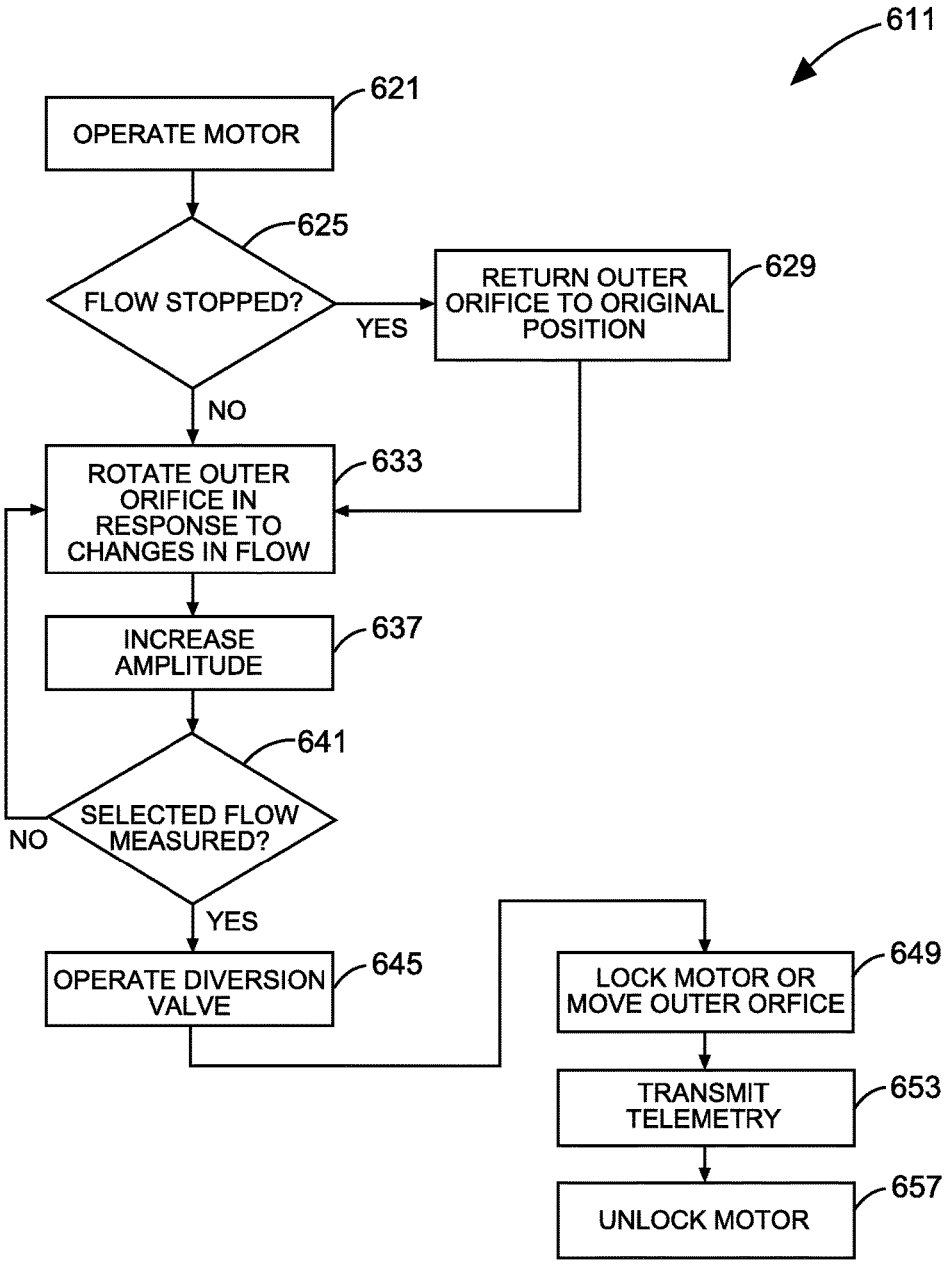
FIG. 6 is a flow chart illustrating several methods according to various embodiments of the invention.

For example, FIG. 6 is a flow chart illustrating several methods 611 of operating an agitator, configured as described previously. Thus, a processor-implemented method 611 to execute on one or more processors that perform the method may begin at block 621 with operating a Moineau motor having a pair of output orifices comprising a selectably movable outer output orifice disposed proximate to a fixed inner output orifice. The activity at block 621 may include rotating the outer output orifice about the longitudinal axis of the motor when drilling fluid is flowing through the pair of orifices to control fluid pressure pulse amplitude from the outer output orifice. The activity at block 621 may also comprise receiving commands to lock or unlock movement of the Moineau motor, such as by locking or unlocking the rotor within the motor.

In some embodiments, the outer output orifice can be moved in response to the detected drilling fluid flow rate. Thus, the method 611 may continue on to block 625 to include determining whether flow to, or within the Moineau motor has substantially stopped (e.g., dropped below a selected lower limit). If so, the output orifice can be returned to its original (fully open) position at block 629. If not, then the method 611 may go directly to block 633 with rotating the outer output orifice about the longitudinal axis of the motor in response to changes in the amount of flow (e.g., flow quantity and/or rate) of the drilling fluid into the motor.

For example, in some embodiments, the output pulse amplitude can be increased over a time delay period, as the drilling fluid flow rate increases. Thus, the method 611 may comprise, at block 637, increasing amplitude of the pressure pulses as a flow rate of the drilling fluid increases, over a selected time delay period.

In some embodiments, the pressure pulse amplitude can be increased when stick-slip and other indications of reduced drilling efficiency are detected. Thus, the activity at block 637 may comprise increasing the fluid pressure pulse amplitude from the outer output orifice by rotating the outer output orifice about the longitudinal axis of the motor during a time period in which one of stick-slip, change in bending moment, or change in weight on bit of a drill string attached to the motor is detected.

A measured quantity of drilling fluid flow can be used to lock the motor, or reduce pressure pulse amplitude, making it easier to transmit telemetry, or make sensitive measurements. Thus, the method 611 may comprise, at block 641, measuring an amount of flow of the drilling fluid into the motor. If a selected flow quantity or rate has not been measured, the method 611 may return to block 633. If the flow quantity or rate meets or exceeds a selected amount, the method 611 may continue on to block 645.

Excessive pressure within the motor can be relieved by diverting some of the fluid flow. Thus, the method 611 may comprise, at block 645, controlling the fluid pressure pulse amplitude from the outer output orifice by diverting some of the drilling fluid through a diversion valve disposed within the motor.

If stick-slip occurs, the diversion of flow can be halted, perhaps abruptly, to encourage axial movement of the drill string. Thus, the activity at block 645 may comprise operating the diversion valve to halt diversion of the drilling fluid upon detecting stick-slip of a drill string attached to the motor.

The method 611 may continue on to block 649 to include locking movement of the motor or moving the outer output orifice to reduce the fluid pressure pulse amplitude during a time delay period when a selected amount of flow has been measured.

In some embodiments, the method 611 may continue on to block 653 to comprise transmitting telemetry during the time delay period. The method 611 may also continue on to block 657 to include unlocking the motor (rotor) to initiate agitation provided by the motor.

It should be noted that the methods described herein do not have to be executed in the order described, or in any particular order. Moreover, various activities described with respect to the methods identified herein can be executed in iterative, serial, or parallel fashion. Information, including parameters, commands, operands, and other data, can be sent and received in the form of one or more carrier waves.

The apparatus 100 and systems 464, 564 may be implemented in a machine-accessible and readable medium that is operational over one or more networks. The networks may be wired, wireless, or a combination of wired and wireless. The apparatus 100 and systems 464, 564 can be used to implement, among other things, the processing associated with the methods 611 of FIG. 6. Modules may comprise hardware, software, and firmware, or any combination of these. Thus, additional embodiments may be realized.

Figure 7:
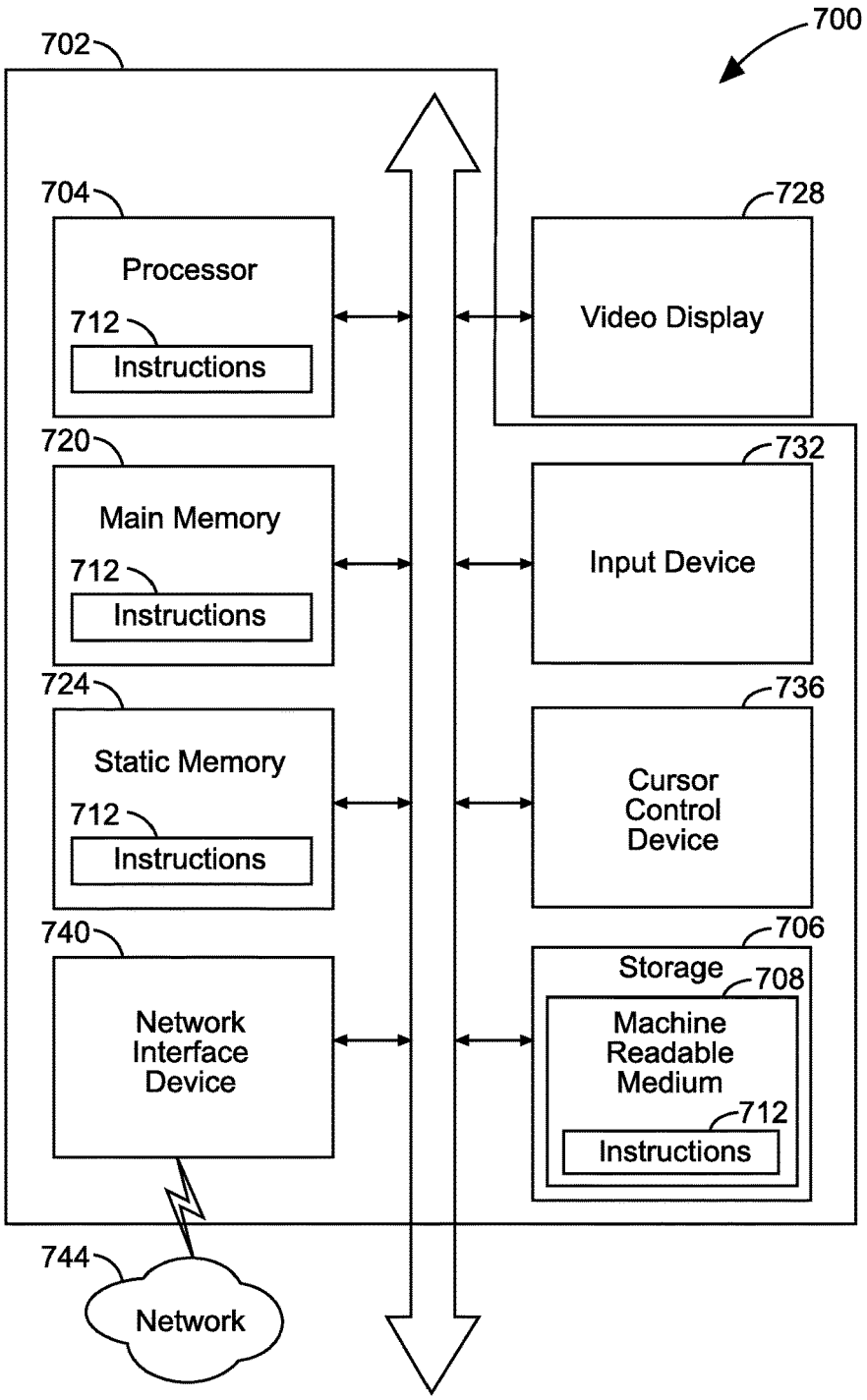
FIG. 7 is a block diagram of an article of manufacture, including a specific machine, according to various embodiments of the invention.

For example, FIG. 7 is a block diagram of an article 700 of manufacture, including a specific machine 702, according to various embodiments of the invention. Upon reading and comprehending the content of this disclosure, one of ordinary skill in the art will understand the manner in which a software program can be launched from a computer-readable medium in a computer-based system to execute the functions defined in the software program.

One of ordinary skill in the art will further understand the various programming languages that may be employed to create one or more software programs designed to implement and perform the methods disclosed herein. For example, the programs may be structured in an object-orientated format using an object-oriented language such as Java or C++. In another example, the programs can be structured in a procedure-oriented format using a procedural language, such as assembly or C. The software components may communicate using any of a number of mechanisms well known to those of ordinary skill in the art, such as application program interfaces or interprocess communication techniques, including remote procedure calls. The teachings of various embodiments are not limited to any particular programming language or environment. Thus, other embodiments may be realized.

For example, an article 700 of manufacture, such as a computer, a memory system, a magnetic or optical disk, some other storage device, and/or any type of electronic device or system may include one or more processors 704 coupled to a machine-readable medium 708 such as memory (e.g., removable storage media, as well as any memory including an electrical, optical, or electromagnetic conductor) having instructions 712 stored thereon (e.g., computer program instructions), which when executed by the one or more processors 704 result in the machine 702 performing any of the actions described with respect to the methods above.

The machine 702 may take the form of a specific computer system having a processor 704 coupled to a number of components directly, and/or using a bus 716. Thus, the machine 702 may be incorporated into the apparatus 100 or systems 464, 564 shown in FIGS. 1-5, perhaps as part of the processors 430, the logic 442, or the workstation 554.

Turning now to FIG. 7, it can be seen that the components of the machine 702 may include main memory 720, static or non-volatile memory 724, and mass storage 706. Other components coupled to the processor 704 may include an input device 732, such as a keyboard, or a cursor control device 736, such as a mouse. An output device 728, such as a video display, may be located apart from the machine 702 (as shown), or made as an integral part of the machine 702.

A network interface device 740 to couple the processor 704 and other components to a network 744 may also be coupled to the bus 716. The instructions 712 may be transmitted or received over the network 744 via the network interface device 740 utilizing any one of a number of well-known transfer protocols (e.g., HyperText Transfer Protocol). Any of these elements coupled to the bus 716 may be absent, present singly, or present in plural numbers, depending on the specific embodiment to be realized.

The processor 704, the memories 720, 724, and the storage device 706 may each include instructions 712 which, when executed, cause the machine 702 to perform any one or more of the activities, operations, or methods described herein. In some embodiments, the machine 702 operates as a standalone device or may be connected (e.g., networked) to other machines. In a networked environment, the machine 702 may operate in the capacity of a server or a client machine in server-client network environment, or as a peer machine in a peer-to-peer (or distributed) network environment.

The machine 702 may comprise a personal computer (PC), a tablet PC, a set-top box (STB), a PDA, a cellular telephone, a web appliance, a network router, switch or bridge, server, client, or any specific machine capable of executing a set of instructions (sequential or otherwise) that direct actions to be taken by that machine to implement the methods and functions described herein. Further, while only a single machine 702 is illustrated, the term "machine" shall also be taken to include any collection of machines that individually or jointly execute a set (or multiple sets) of instructions to perform any one or more of the methodologies discussed herein.

While the machine-readable medium 708 is shown as a single medium, the term "machine-readable medium" should be taken to include a single medium or multiple media (e.g., a centralized or distributed database, and/or associated caches and servers, and or a variety of storage media, such as the registers of the processor 704, memories 720, 724, and the storage device 706 that store the one or more sets of instructions 712. The term "machine-readable medium" shall also be taken to include any medium that is capable of storing, encoding or carrying a set of instructions for execution by the machine and that cause the machine 702 to perform any one or more of the methodologies of the present invention, or that is capable of storing, encoding or carrying data structures utilized by or associated with such a set of instructions. The terms "machine-readable medium" or "computer-readable medium" shall accordingly be taken to include non-transitory, tangible media, such as solid-state memories and optical and magnetic media.

Various embodiments may be implemented as a stand-alone application (e.g., without any network capabilities), a client-server application or a peer-to-peer (or distributed) application. Embodiments may also, for example, be deployed by Software-as-a-Service (SaaS), an Application Service Provider (ASP), or utility computing providers, in addition to being sold or licensed via traditional channels.

Using the apparatus, systems, and methods disclosed herein may provide a number of advantages. These can include reducing the incidence of surveys that fail to pass quality control tests, improved reliability of tool-to-surface communications using mud pulse telemetry, increased time between bit trips (because the agitation apparatus does not need manual adjustment), and increased pulser reliability, since the pulser does not have to run at maximum poppet load to overcome higher agitation noise levels. Increased client satisfaction may result.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus for controlling amplitudes of pressure pulses in a fluid, comprising:

a positive displacement motor operable to produce the pressure pulses in the fluid as the fluid flows through the motor;

a pair of output orifices attached to a fluid output port of the motor, the pair of output orifices comprising a first output orifice and a second output orifice that are selectively movable with respect to each other to control the amplitudes of the pressure pulses when the fluid is flowing through the pair of orifices; and a metering piston to control fluid flow through the motor, based on a pressure difference between inside a housing of the motor and outside the housing of the motor.

2. The apparatus of claim 1, wherein the pair of output orifices have a similar opening configuration.

3. The apparatus of claim 1, further comprising:

a spring to return the first output orifice to an inactive position when flow of the fluid is reduced below a selected lower limit.

4. The apparatus of claim 1, wherein the first output orifice is formed as one of a stadium, an ellipse, or a circle.

5. The apparatus of claim 1, further comprising:

a bearing circumscribing the fluid output port, wherein the first output orifice is attached to rotate against the bearing.

6. The apparatus of claim 1, further comprising:

a gear drive system to couple a plate containing the first output orifice to a housing of the motor, and to permit selective positioning of the first output orifice with respect to the second output orifice during operation of the motor.

7. The apparatus of claim 6, further comprising:

an impeller disposed in a fluid path within the motor, the impeller to provide motive force to the gear drive system.

8. The apparatus of claim 1, further comprising:

an electronic controller to receive commands and to control positioning of the first output orifice with respect to the second output orifice during operation of the motor.

9. The apparatus of claim 1, wherein the pair of output orifices always at least partially overlap with respect to each other.

10. A system for controlling amplitudes of pressure pulses in a fluid, comprising:

at least one of a fluid pulse telemetry transmitter or down hole sensor;

a positive displacement motor operable to produce pressure pulses in the fluid as the fluid flows through the motor a pair of output orifices attached to a fluid output port of the motor, the pair of output orifices comprising a first output orifice and a second output orifice that are selectively movable with respect to each other to control the amplitudes of the pressure pulses when the fluid is flowing through the pair of orifices during some portion of a time of operating the transmitter, the sensor, or both; and a metering piston to control fluid flow through the motor, based on a pressure difference between inside a housing of the motor and outside the housing of the motor.

11. The system of claim 10, further comprising:

a flow meter to measure flow of the fluid, and to enable locking movement of the motor or controlled movement of the first output orifice to reduce the fluid pressure pulse amplitude.

12. The system of claim 10, further comprising:

an electronic controller to receive commands and to enable lockable movement of the motor or controlled movement of the first output orifice to reduce the fluid pressure pulse amplitude.

13. The system of claim 12, wherein the commands comprising commands to lock, unlock, or move are provided by a module configured to monitor flow of the fluid or differential pressure across a housing of the motor.

14. The system of claim 10, further comprising:

a mechanical or electronic delay mechanism to set a delay period for moving the first output orifice from a position of substantial alignment with the second output orifice to substantial non-alignment with the second output orifice as a flow rate of the fluid changes from a lower flow rate to a higher flow rate.

15. A method for controlling amplitudes of pressure pulses in a fluid, the method comprising:

operating a positive displacement motor to produce pressure pulses in the fluid as the fluid flows through the motor;

selectively moving a first output orifice of a pair of output orifices with respect to a second output orifice of the pair of output orifices when fluid is flowing through the pair of orifices to control the amplitudes of the pressure pulses; and controlling the fluid pressure pulse amplitude from the first output orifice by diverting some of the fluid through a diversion valve disposed within the motor.

16. The method of claim 15, wherein selectively moving the first output orifice with respect to the second output orifice comprises moving the first output orifice with respect to the second output orifice in response to changes in an amount of flow of the fluid into the motor.

17. The method of claim 15, further comprising:

increasing amplitude of the pressure pulses as a flow rate of the fluid increases, over a selected time delay period.

18. The method of claim 15, further comprising:

measuring an amount of flow of the fluid into the motor;

locking movement of the motor or moving the first output orifice with respect to the second output orifice to reduce the fluid pressure pulse amplitude during a time delay period when a selected amount of flow has been measured; and transmitting telemetry during the time delay period.

19. The method of claim 15, further comprising:

increasing the fluid pressure pulse amplitude from the first output orifice by moving the first output orifice with respect to the second output orifice during a time period in which one of stick-slip, change in bending moment, or change in weight on bit of a drill string attached to the motor is detected.

20. The method of claim 15, further comprising:

operating the diversion valve to halt diversion of the fluid upon detecting stick-slip of a drill string attached to the motor.

21. The method of claim 15, wherein the operating comprises:

receiving commands to lock or unlock movement of the positive displacement motor.

* * * * *